US005992357A

United States Patent [19]

Tasi

[11] Patent Number: 5,992,357

[45] Date of Patent: Nov. 30, 1999

[54] PISTON DRIVEN AXIAL CYLINDER ENGINE

[76] Inventor: Ylli Tasi, Rr Kavajes Pall. CAFOD A Sh 2 Ap 10, Tirane, Albania

[21] Appl. No.: 09/029,639

[22] PCT Filed: Sep. 6, 1996

[86] PCT No.: PCT/AL96/00001

§ 371 Date: Mar. 3, 1998

§ 102(e) Date: Mar. 3, 1998

[87] PCT Pub. No.: WO97/10415

PCT Pub. Date: Mar. 20, 1997

[30] Foreign Application Priority Data

Oct. 11, 1995 [AL] Albania ..... AL/P95/00041

[51] Int. Cl.[6] ..... F01B 3/00

[52] U.S. Cl. ..... 123/56.2; 123/56.3

[58] Field of Search ..... 123/56.2, 56.3

[56] References Cited

FOREIGN PATENT DOCUMENTS 339 810 11/1989 European Pat. Off. .

1 416 219 2/1966 France .

*Primary Examiner*—Henry C. Yuen

*Assistant Examiner*—Jason Benton

[57] ABSTRACT

Piston driven axial cylinder engine is composed of the flange (1) with the cylinders (10) in a circular disposition, the support (16) of the motor main shaft (2), and the carrier (20) supporting the central pivot (7). Around this central pivot (7), the disc (6) has a mutating motion. The extremity (4) of the shaft describing a circle drives the shaft (2) in rotation. The disc (6) pivots the extremity of the connecting rods (8). The distribution disc(17) with the lobes (18), placed coaxially in the motor main shaft (2) whence it takes its rotation, actuates the valves (12) and (13) placed in the cylinder heads (11). The auxiliary (21), which too takes its rotations from the motor main shaft (2), serves to set in motion the auxiliary equipments. When the pistons are set in motion, as in the case of internal combustion motors, their alternative straight-line motion is transformed in rotative motion of the motor main shaft (2); and vice-versa as in the case of compressors and hydraulic pumps.

5 Claims, 6 Drawing Sheets

Figure 1:
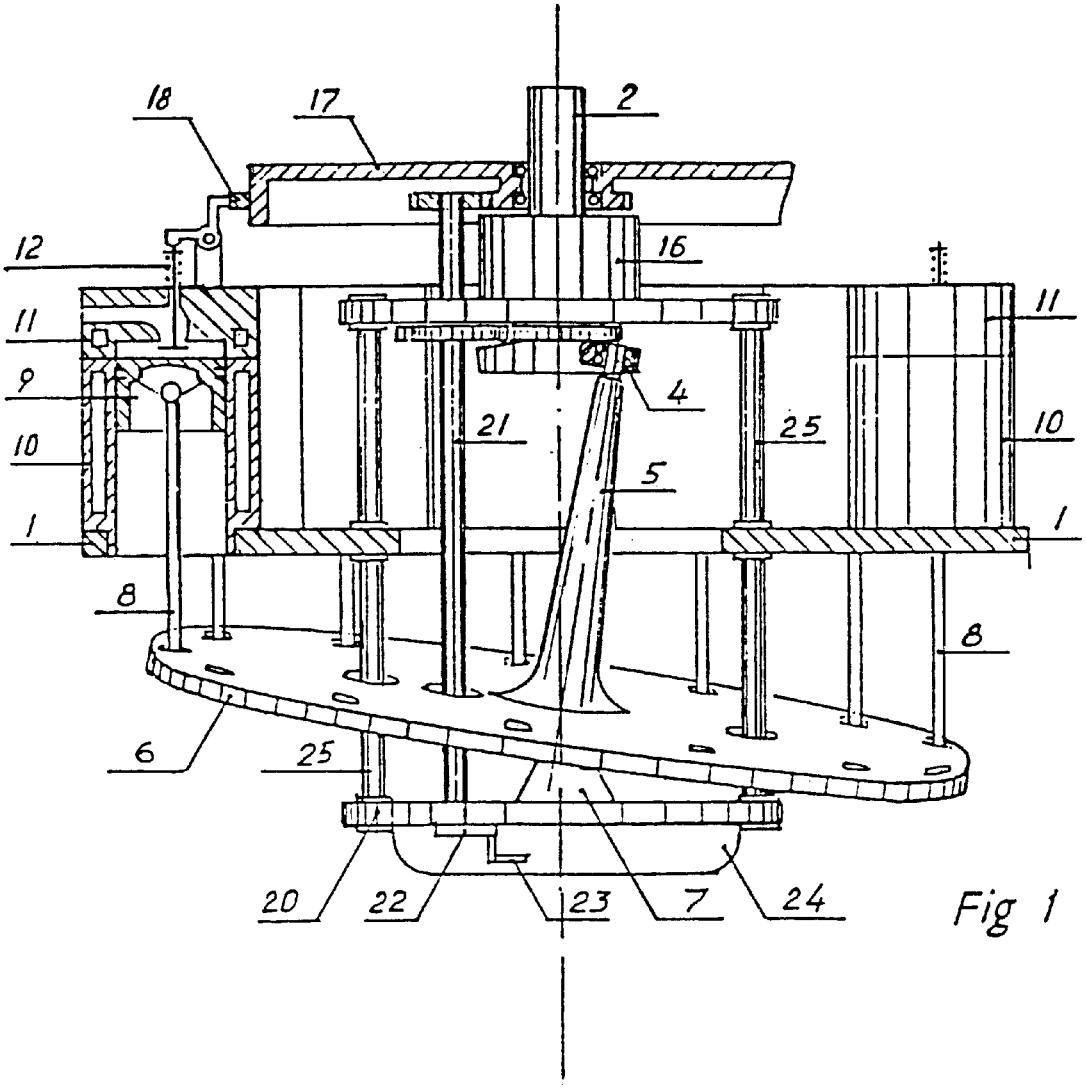

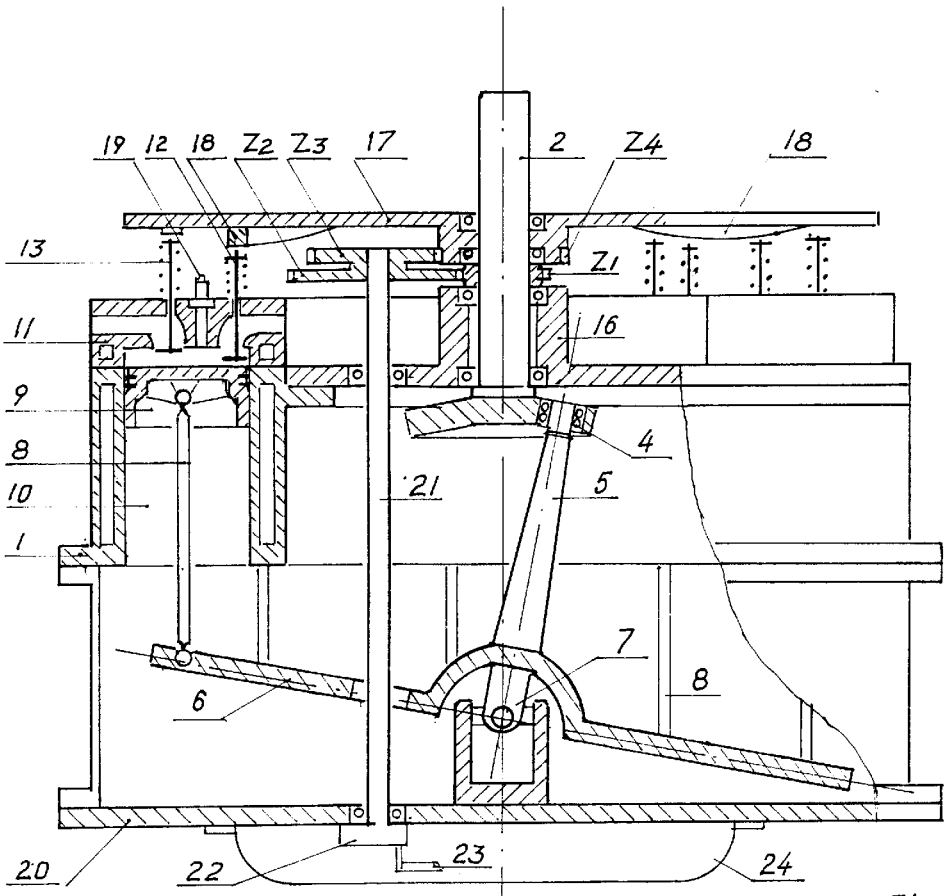
Fig 2 - a
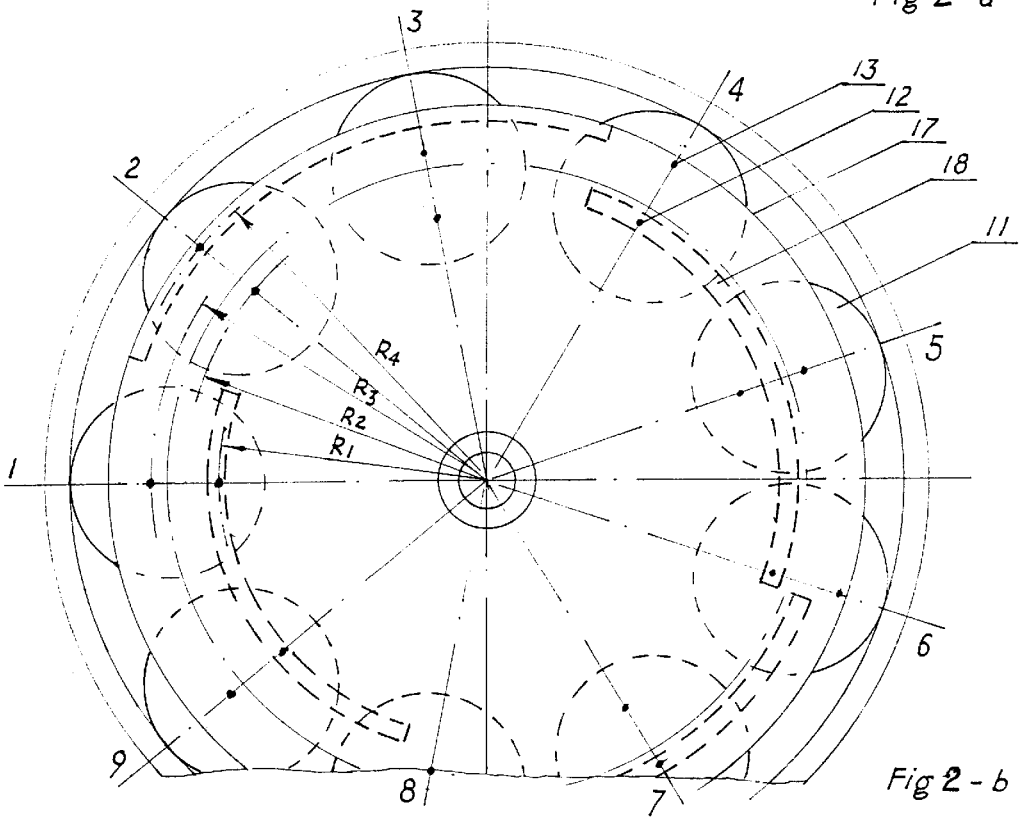
Fig 2 - b

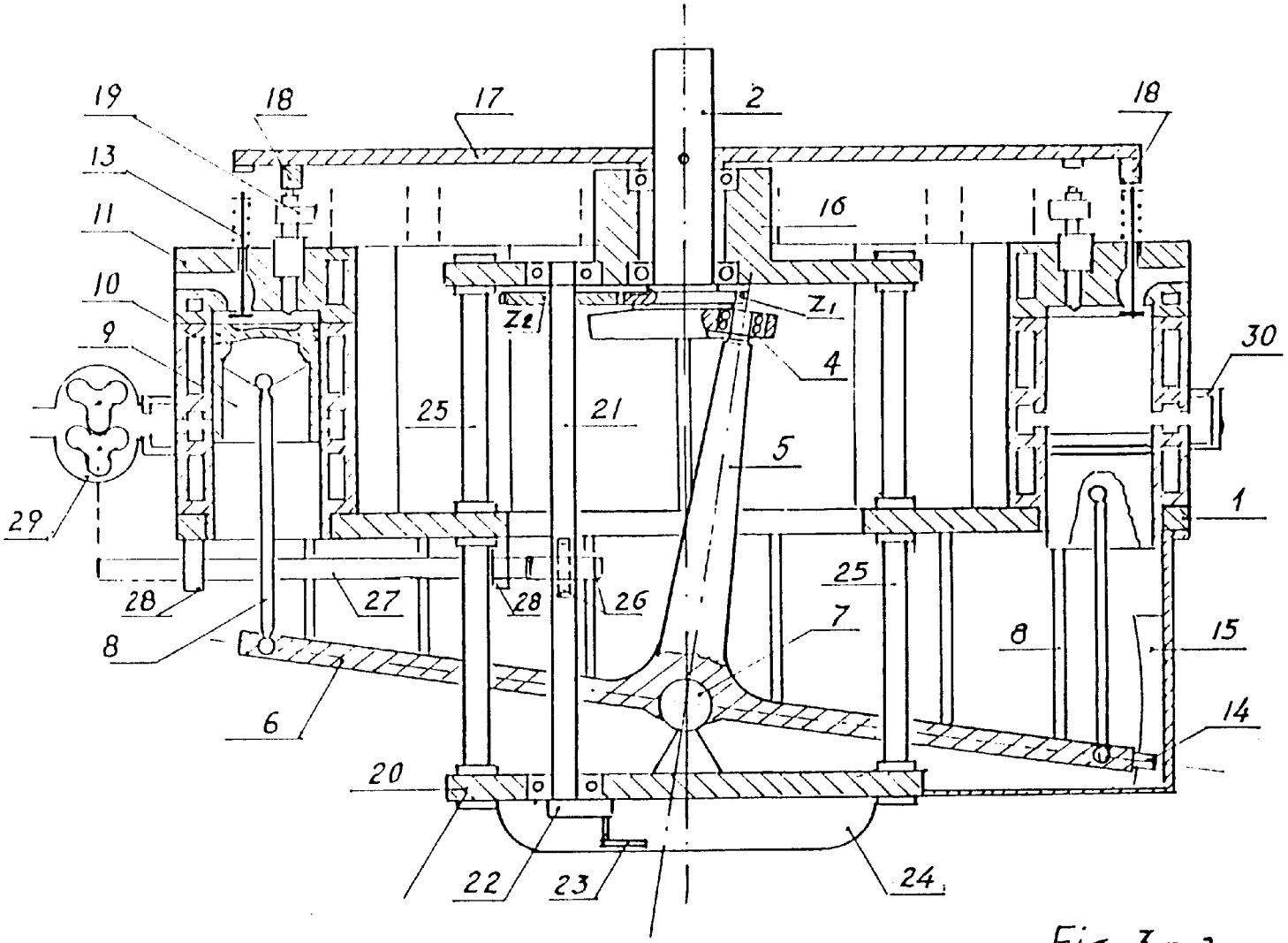
Fig 3-a

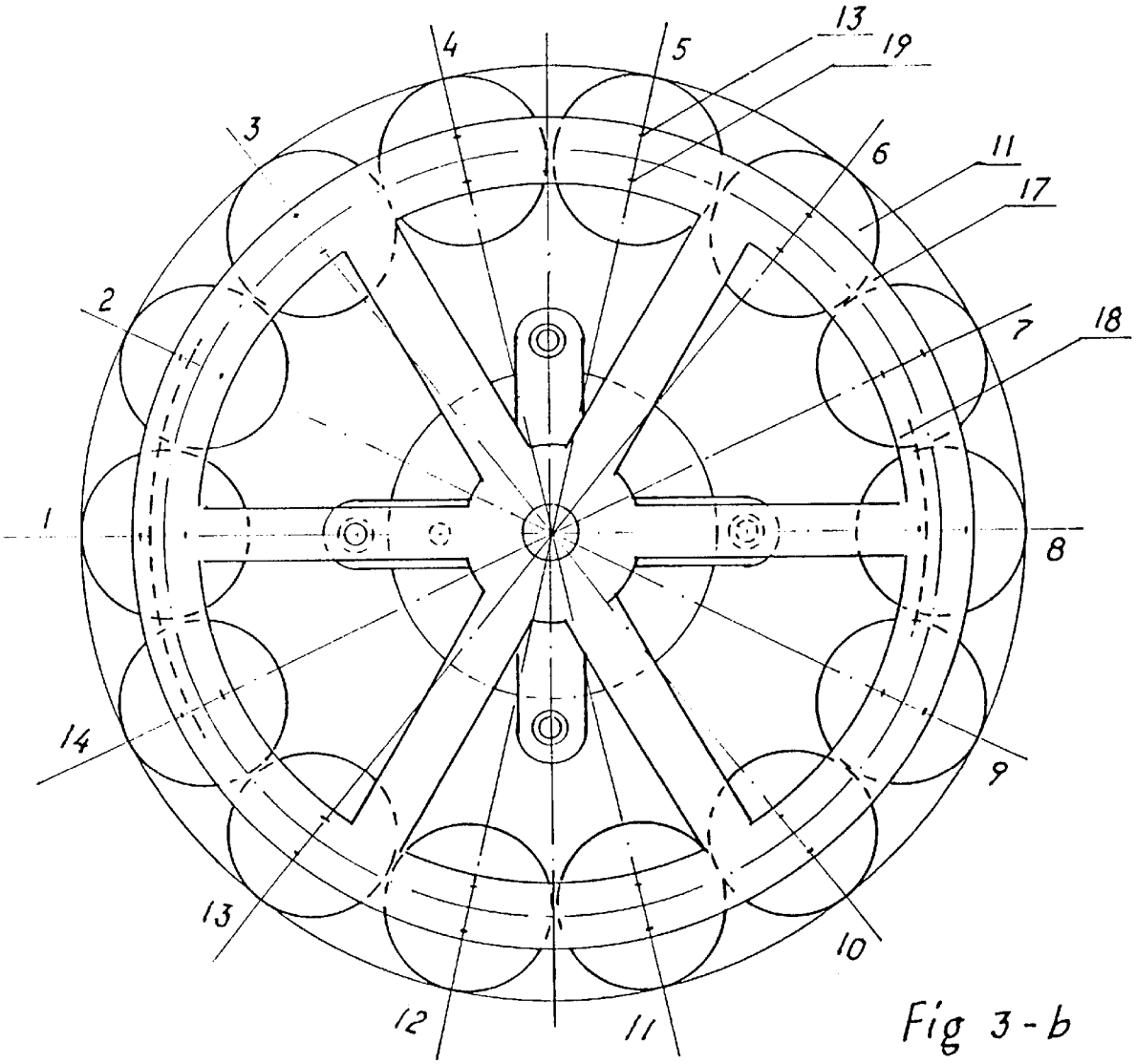
Fig 3-b

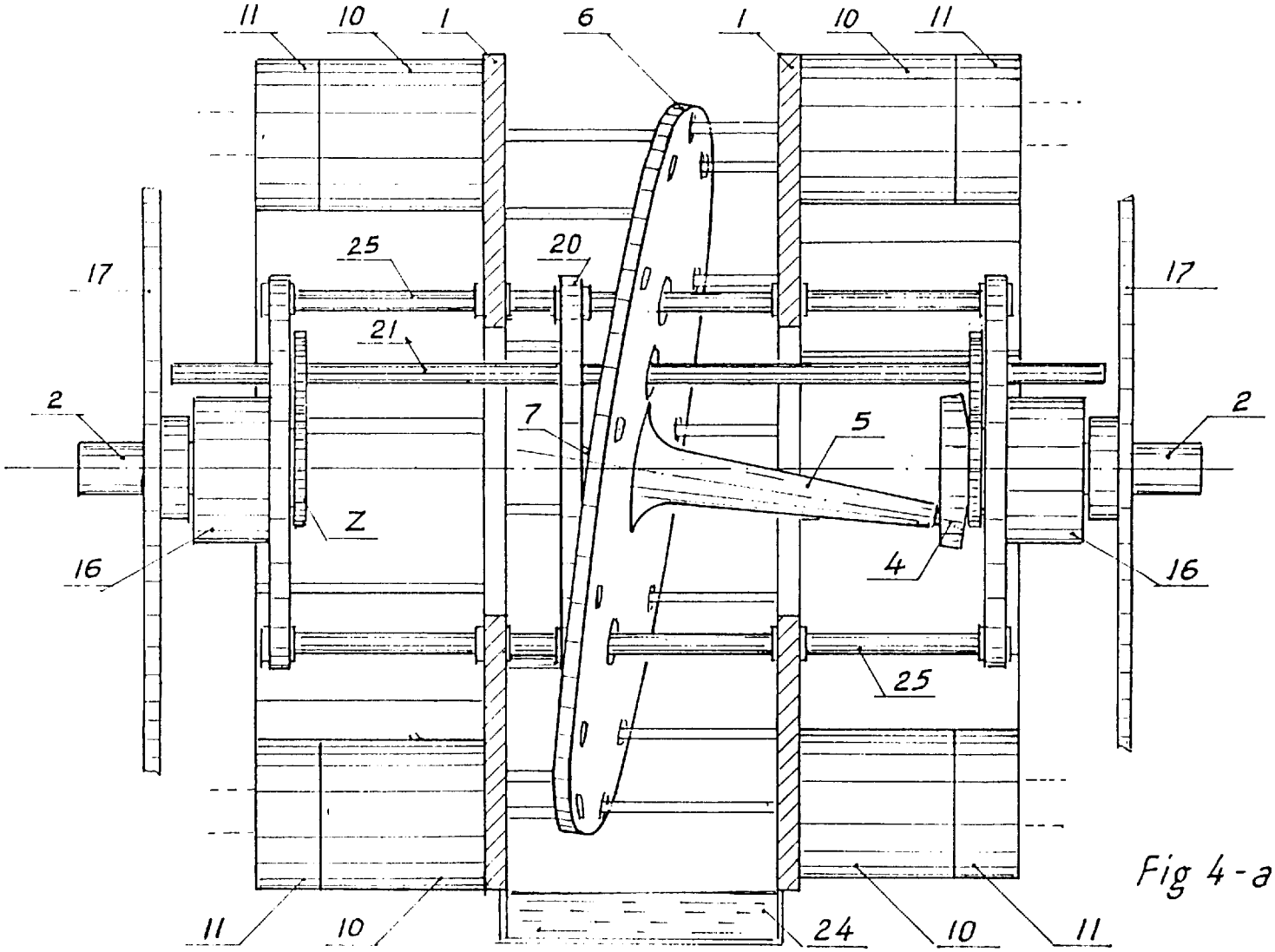
Fig 4-a

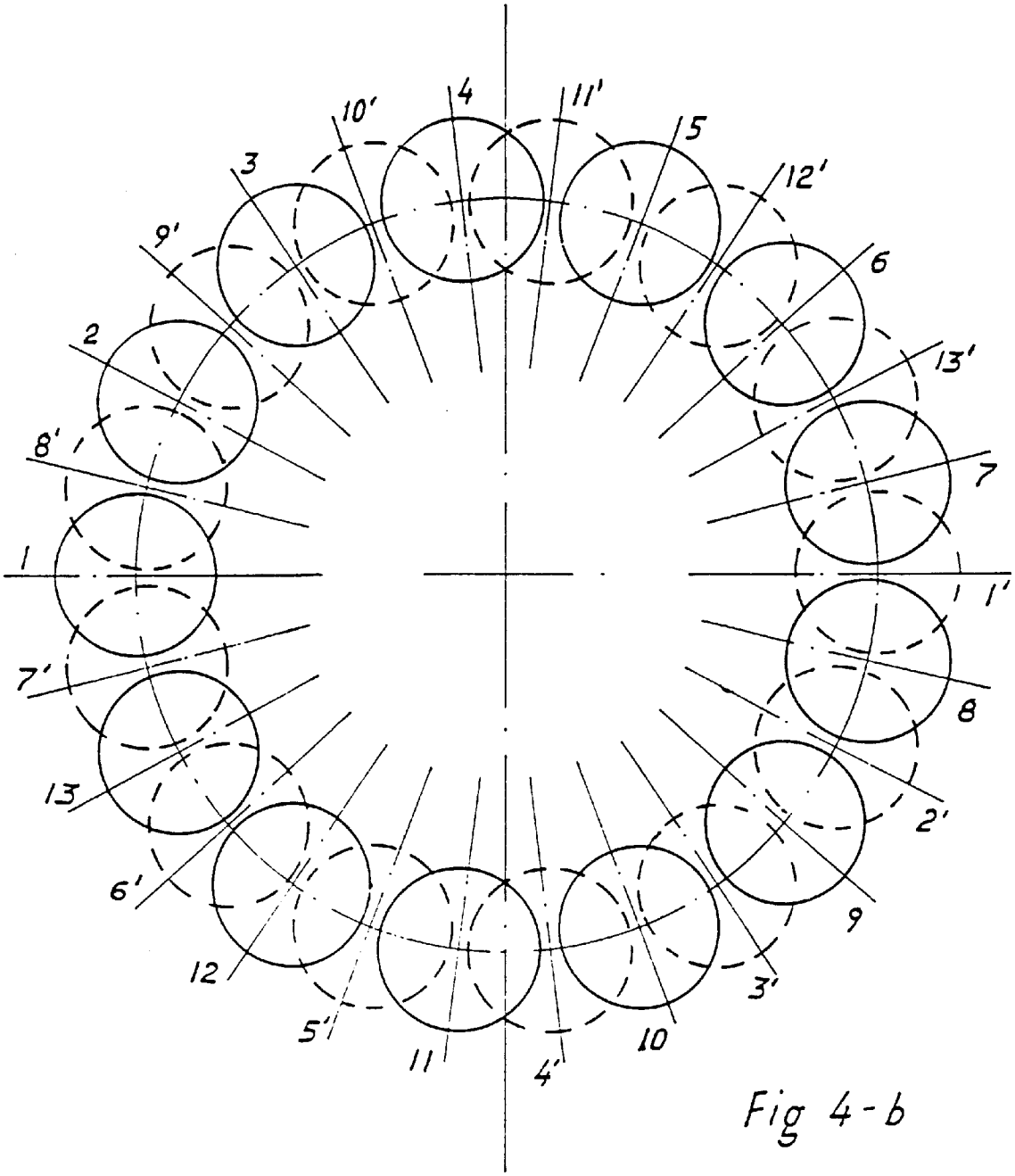
Fig 4-b

PISTON DRIVEN AXIAL CYLINDER ENGINE

This invention aims at the construction of piston aggregates in general, such as internal combustion motors, compressors and hydraulic pumps, where the classic mechanism to transform motion-piston connecting-rod crank-shaft, is substituted by, a new "Mechanism to transform alternative straight line motion into a rotary one and vice versa" presented in the International Application N PCT/EP 95/03551 dated Nov. 9, 1996.

The internal combustion aggregates motors constructed according to this invention can be of two as well as of four stroke cycle aggregate motors, using naphtha (diesel) or benzine (gas), of small, medium, large or even very great power, and of an unlimited number of cylinders. They are described here below:

In Piston driven axial cylinder engine the cylinders are placed in circular form, having their axes parallel altogether and equidistant from each other. In the centre of the circle heaving its axis parallel with those of the cylinders, is the rotative rod (it will be called hereafter the "motor main shaft") which has in its lower extremity a pivot, whose centre with the due eccentricity is located outside the motor main shaft axis. In continuation of the motor main shaft axis, which is also the body's axis, but in a certain distance from the cylinders block, in the lower part of the body is placed the central pivot, having its centre on the motor main shaft axis. At the central pivot, a disc is is pivoted, whose centre fits with that of the central pivot. In the central point of the disc, forming one body with it and perpendicularly on it, there is a bar, whose free extremity is pivoted in the excentric pivot of the motor main shaft. In the periphery of the disc and corresponding to the cylinder axes, connecting rods are pivoted, which in the other extremities have the respective pistons pivoted.

During the revolving of the motor main shaft, the disc bar axis describes a cone, whose basis is the circle described by the excentric pivot centre, and whose apex is the centre of the disc that is the same of the central pivot centre. The disc itself, which is deprived of the freedom to revolve round the axis of the motor main shaft, takes periodically successive inclined positions, depending on the bar position. Consequently, the pistons, guided inside the cylinders do their alternative straight line motion. Vice-versa, as it occurs in ordinary internal combustion motors, where the cylinders get active one after the other, the alternative straight line motion of the pistons turns in rotative motion of the motor main shaft. In the case the aggregates are internal combustion motors, in order to actuate the valves, a second disc (called the "distribution disc") is placed upon the heads and co-axially at the motor main-shaft, from which it takes its rotative motion. In case of two stroke cycle motors where the working cycle is completed in one rotation of the motor main-shaft, the distribution disc is directly fastened in the motor main-shaft, being endowed in its periphery with a ring segment shaped lobe, which actuates by turns the exhaust valves located in a circle and if necessary, with a second lobe, in order to actuate the pump injectors, that are one for each cylinder. In case of four stroke cycle motors, where the working cycle is carried out in two rotations of the motor main shaft, the distribution disc makes a reduced number of the motor main shaft rotations, and in its periphery has four seperated segment ring sized lobes, placed with the due displacement in four concentric circles of the diameters corresponding to the valves. One couple of lobes commands the intake and exhausting valves of the uneven numbered cylinders, whereas the two other lobes command the valves of the even numbered cylinders.

Other ways to command the valves by lobes can be realized through rocker-arms or together rocker arms and pushrods, where the selective contacts are achieved by lobes placed in the disc either in concentric circles on the same plane but of various diameters, or in circles on parallel planes and with the same diameter. This brings the placing of the valves to be the same, both for the uneven numbered cylinders and for those of even number.

An auxiliary shaft traverses the engine body along its full length with its axis parallel to the motor main-shaft axis. This shaft takes by means of a system of gears, one half of the motor main-shaft rotations and sets in motion the distribution disc,the naphtha pump in the cases of the naphtha motors, or the electric distributor for benzine motors, the lubrication system oil pump, mounted in the oil pan, and by means of a transmission issue, the water pump and the cooling system ventilator.

The actuating disc of the valves, which by means of one, two or four lobes, realizing an efficacious destribution, can serve of the same time by taking occasionally the due mass and shape, as an equilibrum fly wheel, as well as a friction, as a transmission pulley etc. The above described motor aggregates, both of two stroke cycle or of four stroke cycle, using naphtha or benzine, have cylinders placed in one block, which could be single block or with individual cylinders mounted in a flange. They can be built also with two cylinder blocks which have in common the motor main-shaft with the excentric pivot, the carrier with the central pivot and the disc with the bar. The flanges of the two cylinder blocks are placed parallel and equidistantly from the central pivot centre, with the cylinder axes in one direction or displaced with the one block towards the other as much as the half of the axial distance. The connecting rods of the second block are pivoted at the same disc, but with contrary directions, in accordance with the cylinder axes, displaced or not.

Another way to place cylinders in a block is to put them in two concentric circles, with the cylinders either in the same radius or in displaced radius. Being different the courses of the pistons of the two circles, and keeping a certain relationship diameter versus course, the cylinder volumes of the external circle differ from those of the internal's which favours the application of this form in two degree compressors, where the air or the copressed gas in cylinders of the external circle, with smaller volume and higher pressure passes to the cylinders of the internal circle, where it is recompressed.

The piston aggregates and especially those of the internal combustion motors, built in conformity to this invention, have a series of advantages in comparison to the traditional motors. Placing the cylinders in a circular form, with the motor main-shaft in their centre and with their axes parallel, the elimination of the crank shaft and its substitution by a disc pivoted only in one point in its centre, gives the aggregate a very simple and compact construction and also the possibility to place in it an almost unlimited number of cylinders, which allows the power to change by varying the number of the cylinders on a very large scale, i.e. to pass from aggregates of few, big, slow pistons to aggregates of numerous, small, fast pistons.

The other great advantage offered by placing the motor main-shaft in the centre of the cylinder block is the simple way of actuating the valves which, being disposed in concentric circles, are very accessible to be actuated by one or four lobes placed in a disc, independently of the number of the cylinders, 5, 50, 100 and more.

The variability of the motor power depending on the cylinders number in a large scale gives a more qualified typification of the details, and together with the simplification of the construction in general and of the configuration of several details in particular, such as those of the mechanism to transform the motion, of the distribution system etc, it would render the casting and the whole technology of the engine production in general easier and less expensive, including that of very great and powerful motors (such as for ships and locomotives).

Another important advantage deriving from the kinetic scheme for the transformation of alternative straight line motion into rotary motion applied in these aggregates according to the invention is its very favourable dynamic. The variable angle that the connecting rod's axis forms with the cylinder's axis is relatively much smaller compared to that of crank shaft motors. Consequently, the radial component of the forces acting on the piston or the friction force piston versus cylinder results very small and all the same the friction forces in other couplings or knuckle joints are reduced, with the possibility of their peculiar changing from slippery friction to a rolling one, as a consequence of which we have a reduction of the energy loss in friction, therefore increase of mechanical productivity, fuel saving, decrease of the length of the piston, and also its lightening, increase of its speed, of its longevity as well as that of the cylinders and of the whole aggregate etc.

The repair of the aggregates too becomes easier and less expensive.

The invention will now be described by way of some examples and with reference to the relative drawings:

FIG. 1 shows the mechanism to transform motion applied according to the invention in an internal combustion motor.

FIG. 2-*a* shows a partial section after the axis of a four stroke cycle internal combustion motor with nine cylinders in monoblock.

FIG. 2-*b* shows the way of placing the cylinders with their numbers, the positions of the valves in the heads and of the lobes in the distribution disc, viewed from above.

FIG. 3-*a* shows a section after the axis of a two stroke cycle internal combustion motor, diesel, with fourteen cylinders placed in a block.

FIG. 3-*b* shows the way of placing the cylinders, with their numbers and the position of the lobes in the distribution disc, viewed from above.

FIG. 4-*a* shows an internal combustion motor with 2×13 cylinders placed in two blocks.

FIG. 4-*b* shows the way of placing the cylinders in two blocks, and their numbers.

FIRST EXAMPLE

A four stroke cycle internal combustion motor with nine cyclinders placed in a block FIG. 2-*a*, and FIG. 2-*b*.

The cylinder block, being in this motor a monoblock, has a cylindrical ring shape, in which the cylinders 10 are placed in circular form, with their axes parallel and in equal distance from each other. On the cylinder block, the support 16 is mounted, having their axes fitted. The support 16 has the motor main-shaft 2 which, staying on two bearings, performs rotative motion only. In its lower extremity, the motor main shaft 2 has the excentric pivot 4. Below the cylinder block and within a certain distance is mounted the carrier 20 with the central pivot 7, whose centre is on the motor main shaft 2 axis or on the body axis. In the central pivot 7, which in this case is Cardan Cross type (having two degrees freedom), is pivoted at the disc 6, in its centre,and its bar 5 in its free extremity is pivoted in the excentric pivot 4 (of the motor main-shaft 2). The connecting rods 8 with the pistons 9 are pivoted in the peripheral area of the disc 6 in a way their pivoting centres correspond to the cylinder 10 axes and stretch in the same plane of the disc 6 pivoting centre or of the central pivot 7. Upon the cylinders 10 are mounted the heads 11 with the valves placed on them, in a way the intake valves 12 and the exhausting valves 13 of the uneven numbered cylinders and those of the even numbered cylinders to be disposed on four concentric circles with varying diameters. The distribution disc 17, mounted coaxially at the motor main shaft 2, takes from it reduced rotations, by means of the auxiliary shaft 21. The lobes 18, having a ring segment shape, placed on the disc 17 with the due displacement in concentric circles with different diameters in correspondence to the valves, command directly these valves. The two circle lobes 18 command the intake valves 12 and the exhausting ones 13 of the uneven numbered cylinders, whereas the two other circle lobes command the valves 12 and 13 of the even numbered cylinders, realizing thus the required distribution diagram and the ingition turn 1-3-5-7-9-2-4-6-8 for this motor.

The auxiliary shaft 21 with its two bearings (ball bearings) mounted on the support 16 and on the carrier 20, takes one half of the rotations of the motor main shaft 2 by means of the gears Z-1 and Z-2, and transmits these rotations to the distribution disc 17. The auxiliary shaft 21 also, whose axis is parallel with the motor main shaft 2 axis, traverses the disc 6 and sets in fuction the oil pump 22, mounted on the carrier 20, which through the filter 23 inhales the oil in the oil pan 24 and supplies the whole lubrication system. From the same auxiliary shaft 21, take their motion also the naphtha pump or the electric distributor, that may be placed upon the support 16, and through a transmission issue, also the water pump together with the ventilator.

SECOND EXAMPLE

A two stroke cycle internal combustion motor, diesel, with 14 cylinders placed in one block. FIG. 3-*a* and FIG. 3-*b*

In these motors the cylinder block is made up by single cylinders 10 mounted on the flange 1. The flange 1, the support 16 that holds the motor main shaft 2, and the carrier 20, having the central pivot 7 in the centre, are made a body, the motor body, by means of four stand off bolts 25, which traverse the disc 6 in its four spaces. The distribution disc 17 is fixed directly on the motor main shaft 2 and hence takes its rotations. The two lobes 18 in the disc 17 periphery actuate directly, one the gas exhaust valves 13, and the other, the pump injectors 19 that are one in each cylinder. Being a two stroke cycle motor, the firing order is 1-2-3-4-5-6-7-8-9-10-11-12-13-14. The auxiliary shaft 21, its axis being parallel with those of the stand off bolts 25, and with that of the motor main shaft 2 from which it takes its rotations by means of the gears $Z_1$ and $Z_2$, traverses the disc 6 and sets in motion the oil pump 22, also through the gears 26 the shaft 27, which rotates above the supports 28 and is coupled to the washing turbine 29, which by means of the intake manifold 30 put air into the cylinders. The central pivot 7 in this motor, as a variant, is chosen of a spherical type with three degrees of freedom. In order to remove one axis of rotation, that of rotation round the motor main shaft 2 axis, a pin 14 is put in a radial direction on the disc 6 and the arch shaped guide 15 on the body.

Finally, it is worth saying that the motor bodies, built according to this invention, result in simpler frames.

THIRD EXAMPLE

Internal combustion motors with 2×13 cylinders placed in two blocks. FIG. 4-*a* and FIG. 4-*b*

The motors of this example are with two blocks cylinders, that can belong to different types and are built roughly in the same way to those of the second example.

In these constructions we have two flanges 1 of the cylinders 10, two supports 16 with their motors main shaft 2 and one carrier 20 with the central pivot 7, elements that get united as a body, according to defined distances and conditions, by means of the stand off bolts 25 which traverse the disc 6. The flanges 1 of the two cylinder blocks are placed parallel, in front of each other and equidistant from the central pivot 7 centre, with the cylinder axes parallel and displaced as much as the half of the distance between axes. The connecting-rods 8 of the second block are pivoted in the disc 6 in the contrary direction to those of the first block and displaced in order to correspond to the relative cylinders axes. The auxiliary shaft 21 having its axis parallel to the body axis, traverses the disc 6 and the carrier 20, and by means of the gear couple Z transmits motion and power from the active motor main shaft 2 to the deprived of excentric pivot second block passive motor main shaft 2, and to all auxiliary equipment necessary for the motor type.

Having insight the rotation sense of the two distribution disc 17 for setting in phase, and designating the first block cylinders with numbers from 1 to 13, whereas the second block with 1' to 13', placed diametrically contrary (180 degrees); we will have a simultaneous ignition for the identically numbered cylinders of the two blocks, in the following succession, for the two stroke cycle motors: 1+1', 2+2', 3+3', 4+4', 5+5', 6+6', 7+7', 8+8', 9+9', 10+10', 11+11', 12+12', 13+13', and for the four stroke cycle motors: 1+1', 3+3', 5+5', 7+7', 9+9', 11+11', 13+13', 2+2', 4+4', 6+6', 8+8', 10+10', 12+12'.

Motors of such kind of construction, which render possible a redoubling of cylinders in the same aggregate diameter, can be used with priority in course cars (race-cars Formula 1) as well as in aviation, navy etc.

I claim:

1. Piston driven axial cylinder engine comprising, a cylinder block wherein the cylinders with their axes parallel and equidistant are arranged on a flange in a circular arrangement, having in the centre the motor main shaft, with its axis parallel to those of the cylinders, the flange being attached to stand off bolts, which flange and bolts make up part of a support body also comprising the support of the abovesaid motor main shaft, as well as the support carrier of the central pivot located in a way that the centre of this central pivot be on a continuation of the motor main shaft axis and spaced a certain distance from the cylinder block, the said central pivot on which, and in a way that their centres coincide, a disc is pivoted, which disc has in its centre and perpendicularly an integral bar, whose free extremity is pivoted in the excentric pivot of the motor main shaft, the said disc, being deprived of the freedom to rotate around the motor main shaft, has connecting rods pivoted in its periphery, whose pivoting centres correspond to the cylinders axes and are located equidistantly between each other as well as from the disc centre, and lye in one plane, which plane passes also through the disc pivoting centre, the connecting rods, being rigid and endowed with pivots in both ends, are pivoted in the other extremity to pistons, which are engaged in a sliding way to the cylinders, the said cylinders being shut in one end by the heads endowed with valves, the said valves being actuated by the lobes of the distribution disc, said distribution disc, that being located on the motor main shaft, takes its motion directly by it, or by the auxiliary drive disc, the said auxiliary drive shaft which taking its rotating motion by the motor main shaft of the first cylinder block, transmits it to the motor main shaft of the second cylinder block in case of a two cylinder blocks engine.

2. Piston driven axial cylinder engine, according to claim 1 wherein the engine comprises two cylinder blocks, their arrangement is parallel, equidistant from the central pivot centre and having their main shaft axes coinciding.

3. Piston driven axial cylinder engine according to claim 1 wherein the valves are driven from the distribution disc directly.

4. Piston driven axial cylinder engine according to claim 1 wherein the valves are driven from the distribution disc via lobes, rocker-arms and pushrods.

5. Piston driven axial cylinder engine according to any previous claim wherein the auxiliary shaft has its axis parallel to that of the motor main shaft, and traverses the disc and the support body to transmit rotation to the various equipments.

* * * * *